US012108922B2

(12) United States Patent
Matrunola et al.

(10) Patent No.: US 12,108,922 B2
(45) Date of Patent: Oct. 8, 2024

(54) MACHINE AND METHOD FOR PROCESSING A SCREEN PRINTING FRAME

(71) Applicants: Dennis Matrunola, Phoenix, AZ (US); Michael Matrunola, Phoenix, AZ (US)

(72) Inventors: Dennis Matrunola, Phoenix, AZ (US); Michael Matrunola, Phoenix, AZ (US)

( * ) Notice: Subject to any disclaimer, the term of this patent is extended or adjusted under 35 U.S.C. 154(b) by 0 days.

(21) Appl. No.: 18/433,696

(22) Filed: Feb. 6, 2024

(65) Prior Publication Data

US 2024/0277196 A1 Aug. 22, 2024

Related U.S. Application Data

(60) Provisional application No. 63/443,573, filed on Feb. 6, 2023.

(51) Int. Cl.

| | |
|---|---|
| ***A47L 7/00*** | (2006.01) |
| ***B24B 7/06*** | (2006.01) |
| ***B24B 7/10*** | (2006.01) |
| ***B24B 27/00*** | (2006.01) |
| ***B24B 39/06*** | (2006.01) |
| ***B24B 41/06*** | (2012.01) |
| ***B24B 55/04*** | (2006.01) |
| ***B24B 55/06*** | (2006.01) |
| *B24B 9/10* | (2006.01) |
| *B24B 41/053* | (2006.01) |

(52) U.S. Cl.

CPC ..... *A47L 7/0095* (2013.01); *B24B 7/06* (2013.01); *B24B 7/10* (2013.01); *B24B 27/0069* (2013.01); *B24B 27/0076* (2013.01); *B24B 39/065* (2013.01); *B24B 41/068* (2013.01); *B24B 55/04* (2013.01); *B24B 55/06* (2013.01); *B24B 9/10* (2013.01); *B24B 27/0023* (2013.01); *B24B 41/053* (2013.01)

(58) Field of Classification Search

CPC .... B24B 7/06; B24B 7/12; B24B 7/19; B24B 7/22; B24B 7/28; B24B 7/30; B24B 9/10; B24B 9/102; B24B 27/0023; B24B 27/0046; B24B 27/0069; B24B 27/0076; B24B 47/04; B24B 55/04; B24B 55/06; B24B 55/12

USPC ..... 451/41, 260, 184, 11

See application file for complete search history.

(56) References Cited

U.S. PATENT DOCUMENTS 2,453,339 A * 11/1948 Peterson ..... B24B 7/12 451/109
2,837,876 A * 6/1958 Kocher ..... B24B 9/102 451/301
2,969,624 A * 1/1961 Castine, Jr. ..... B24B 9/102 451/299
3,800,477 A * 4/1974 Jendrisak ..... B24B 21/002 451/301
4,060,938 A * 12/1977 Barron, Sr. ..... B24B 9/10 451/388

(Continued)

*Primary Examiner* — Makena S Markman

(74) *Attorney, Agent, or Firm* — Thomas W. Galvani, P.C.; Thomas W. Galvani

(57) ABSTRACT

A machine for processing a screen printing frame includes an upstream end and an opposed downstream end, a grinding assembly located between the upstream and downstream locations, wherein the grinding assembly includes a first grinder configured to grind a first pattern into the screen printing frame and a second grinder configured to grind a second pattern into the screen printing frame different from the first grinding pattern.

16 Claims, 9 Drawing Sheets

(56) References Cited

U.S. PATENT DOCUMENTS

| | | | | |
|---|---|---|---|---|
| 4,375,738 | A * | 3/1983 | Bando | B24B 9/10 451/4 |
| 4,837,984 | A * | 6/1989 | David | B24B 7/28 451/57 |
| 5,924,911 | A * | 7/1999 | Br.ang.lander | B24B 7/12 451/130 |
| 6,234,882 | B1 * | 5/2001 | Young | B28D 7/02 451/260 |
| 7,351,130 | B1 * | 4/2008 | Chang | B24B 29/005 451/65 |
| 2006/0070922 | A1 * | 4/2006 | LaVeine | B07B 9/00 209/231 |
| 2022/0274223 | A1 * | 9/2022 | Ku | B24B 7/12 |

* cited by examiner

MACHINE AND METHOD FOR PROCESSING A SCREEN PRINTING FRAME

CROSS-REFERENCE TO RELATED APPLICATIONS

This application claims the benefit of U.S. Provisional Application No. 63/443,573, filed Feb. 6, 2023, which is hereby incorporated by reference in its entirety.

FIELD

The present specification relates generally to screen printing, and more particularly to systems and methods for preparing screen printing frames for re-use.

BACKGROUND

Screen printing is a technique to repeatedly print a pattern onto a substrate. In screen printing, a mesh screen is stretched tightly over a rectangular frame and adhered thereto. The mesh screen carries a design or stencil to be printed onto the substrate, such as a t-shirt, a bottle, a canvas, etc.

The operator places an emulsion across the surface of the screen, and then selectively removes portions of the emulsion to define a stencil of the design for printing. When the screen is placed on the substrate and ink is pressed against the screen, the emulsion blocks transmission of the ink. The stencil portions, however—where the emulsion is missing—allow the ink to pass through the screen and onto the substrate. The design is thus printed onto the substrate.

This process can be repeated many times with the same mesh screen on one frame. However, eventually, the screen loses tension on the frame, becomes unusable, and needs to be replaced. The screen is removed from the frame and discarded. The frame must be cleaned and prepared before a new screen can be placed over it.

Currently, cleaning and preparing a frame is done by hand, usually by running an angle grinder across the frame. This can take a long time. A skilled worker can prepare only a few frames in an hour. Not only is preparing a frame a slow process, but it is prone to inconsistency. Even the most skilled and experienced worker will cut into the frame at differing depths when using the angle grinder by hand. This can lead to quality inconsistency in the printing process and shortened longevity for each mounted screen. There is a need for an improved system and method for cleaning and preparing a screen printing frame.

SUMMARY

In an embodiment, a machine for processing a screen printing frame including an upstream end and an opposed downstream end, a grinding assembly located between the upstream and downstream locations, and the grinding assembly has a first grinder configured to grind a first pattern into the screen printing frame and a second grinder configured to grind a second pattern into the screen printing frame different from the first grinding pattern.

In embodiments, the machine includes a track mounted to move the screen printing frame from the upstream end to the downstream end. The grinding assembly is disposed over a side of the track, and an opposed side of the track is uncovered. A hood mounted over the grinding assembly. The hood is spaced above the track to define a gap therebetween, and the gap has a height corresponding to a thickness of the screen printing frame. The track includes opposed chains, spaced-apart slats extending between the chains, and stops project upwards from each slat, wherein the stops are registered with each other along the track. A basin is below the grinding assembly and is coupled to a vacuum. The first grinder has a first orientation, and the second grinder has a second orientation different from the first orientation.

In an embodiment, a machine for processing a screen printing frame includes a track for downstream movement of the screen printing frame along a longitudinal axis from an upstream end of the track to an opposed downstream end of the track, a grinding location between the upstream and downstream ends, a first grinder mounted in the grinding location, and a second grinder mounted in the grinding location downstream from the first grinder.

In embodiments, the first and second grinders are registered with each other parallel to the longitudinal axis. The first and second grinders have different orientations with respect to each other. A hood is in the grinding location over the first and second grinders, and the hood has an open bottom. The track is formed with a plurality of openings through the track. A basin is below the grinding location and is coupled to a vacuum. The grinding assembly is disposed over a side of the track, and an opposed side of the track is uncovered.

In an embodiment, a machine for processing a screen printing frame includes a track for downstream movement of the screen printing frame along a longitudinal axis from an upstream end of the track to an opposed downstream end of the track, a grinding location between the upstream and downstream ends, a first grinder mounted in the grinding location, the first grinder including a first motor, a first shaft coupled to the first motor for driven rotation, and a first grinding media on the first shaft, and a second grinder mounted in the grinding location, the second grinder including a second motor, a second shaft coupled to the second motor for driven rotation, and a second grinding media on the second shaft.

In embodiments, the first and second grinders are registered with each other parallel to the longitudinal axis. The first and second grinders have different orientations with respect to each other. A hood is over the first and second grinders, and the hood has an open bottom. The track is formed with a plurality of openings through the track. A basin is below the grinding location and is coupled to a vacuum. The first and second grinders are disposed over a side of the track, and an opposed side of the track is uncovered.

The above provides the reader with a very brief summary of some embodiments described below. Simplifications and omissions are made, and the summary is not intended to limit or define in any way the disclosure. Rather, this brief summary merely introduces the reader to some aspects of some embodiments in preparation for the detailed description that follows.

BRIEF DESCRIPTION OF THE DRAWINGS

Referring to the Drawings.

DETAILED DESCRIPTION

Figure 1:
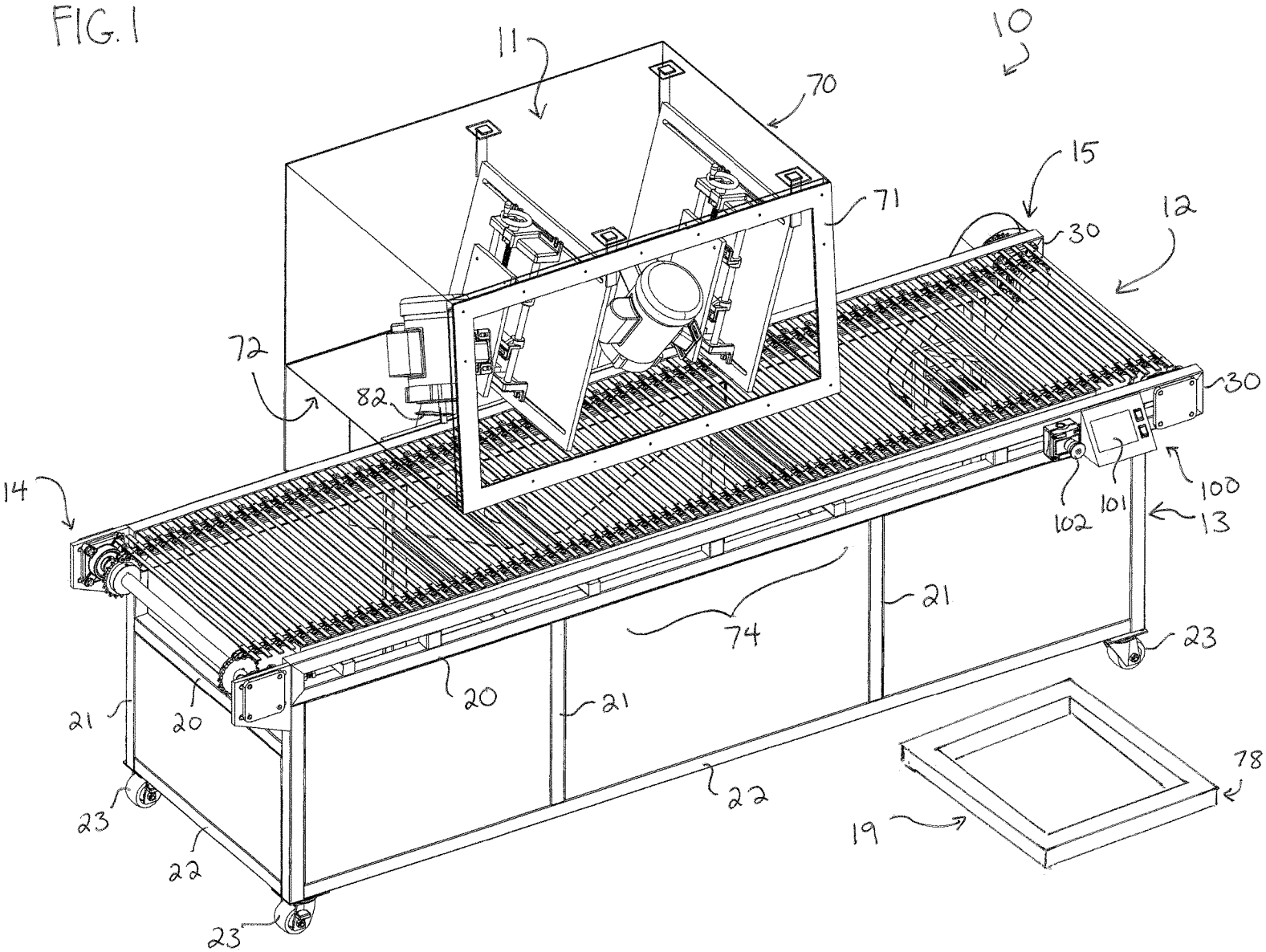
FIG. 1 is a front, top perspective view of a screen printing frame processing machine.

Reference now is made to the drawings, in which the same reference characters are used throughout the different figures to designate the same elements. Briefly, the embodiments presented herein are preferred exemplary embodiments and are not intended to limit the scope, applicability, or configuration of all possible embodiments, but rather to provide an enabling description for all possible embodiments within the scope and spirit of the specification. Description of these preferred embodiments is generally made with the use of verbs such as "is" and "are" rather than "may," "could," "includes," "comprises," and the like, because the description is made with reference to the drawings presented. One having ordinary skill in the art will understand that changes may be made in the structure, arrangement, number, and function of elements and features without departing from the scope and spirit of the specification. Further, the description may omit certain information which is readily known to one having ordinary skill in the art to prevent crowding the description with detail which is not necessary for enablement. Indeed, the diction used herein is meant to be readable and informational rather than to delineate and limit the specification; therefore, the scope and spirit of the specification should not be limited by the following description and its language choices.

FIG. 1 is a top perspective view of a screen printing frame processing machine 10 (hereinafter, "the machine"). The machine 10 includes a grinding assembly 11 mounted above a track 12 supported on a framework 13. An operator places a used rectangular screen frame 19, with the mesh screen removed, near an upstream end 14 of the machine 10, registering it against one side of the track 12. The operator then allows the moving track 12 to translate the frame 19 from the upstream end 14, under the grinding assembly 11, and toward a downstream end 15 of the machine 10. The grinding assembly 11 grinds a top surface of one side of the frame 19 in preferably two different ways to process one side of the frame 19. The operator repeats this process for all sides of the frame 19 and can complete the screen frame preparation process in about a minute or two.

The framework 13 is a strong, rigid, rugged, and durable support for the machine 10. The framework 13 includes structural struts, preferably made of steel or aluminum, including upper horizontal frame elements 20, vertical frame elements 21, and lower horizontal frame elements 22. The frame elements are preferably welded together to form a rigid box structure. Lockable casters 23 on the bottom of the framework 13 allow the operator to roll and then lock the machine 10 in different locations.

The machine 10 has an upstream end 14 and an opposed downstream end 15, corresponding to the direction the operator moves a screen frame 19 through the machine 10. In FIG. 1, the upstream end 14 is shown on the left-hand side of the page and the downstream end 15 is shown on the right-hand side of the page. This specification uses the terms "upstream" and "downstream" throughout its description to indicate a direction of movement or a relative positioning or an arrangement of structural elements and features with respect to each other.

Figure 2:
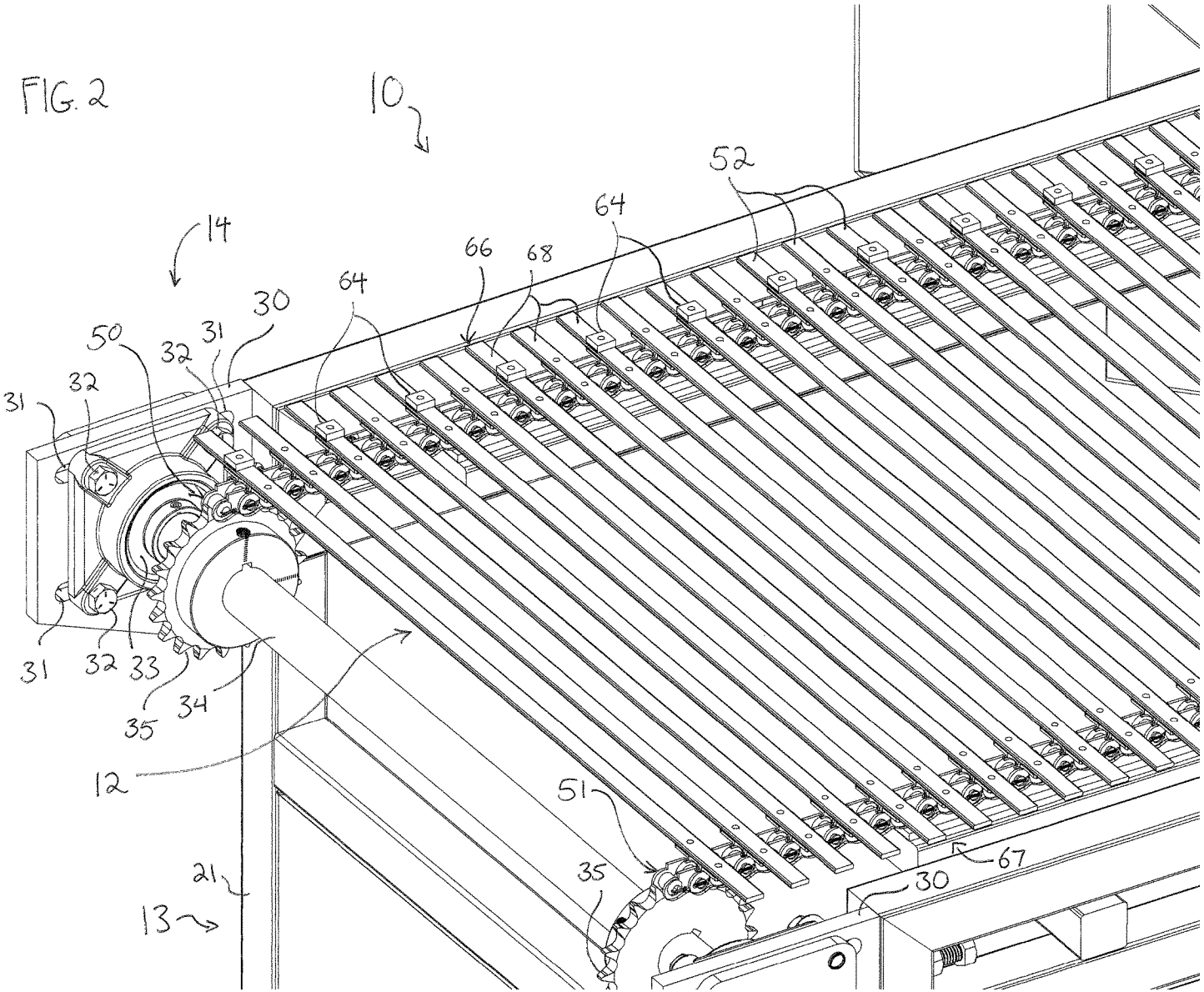
FIG. 2 is an enlarged view of an upstream end of the machine of FIG. 1, showing a track.

Turning to FIG. 2, the framework 13 includes mounts 30 for the track 12 at the upstream end 14. Similar mounts 30 are at the downstream end 15, as shown in other figures. The mounts 30 are brackets fixed to or formed integrally with the framework 13, and which extend just beyond the vertical frame elements 21 at the ends 14 and 15. The mounts 30 are each identical and only one is described here, with the understanding that the description applies equally to all of the mounts 30. The mount 30 has a pattern of bolt holes 31 formed transversely through it. Bolts 32 extend through the holes 31 and fix a hub 33 onto the mount 30. The hub 33 holds a rotating axle 34 for the track 12. With four hubs 33—two at the upstream end 14 and two at the downstream end 15—two axles 34 are supported by the framework 13. The track 12 rides on gears 35 fixed on those axles 24.

Figure 3:
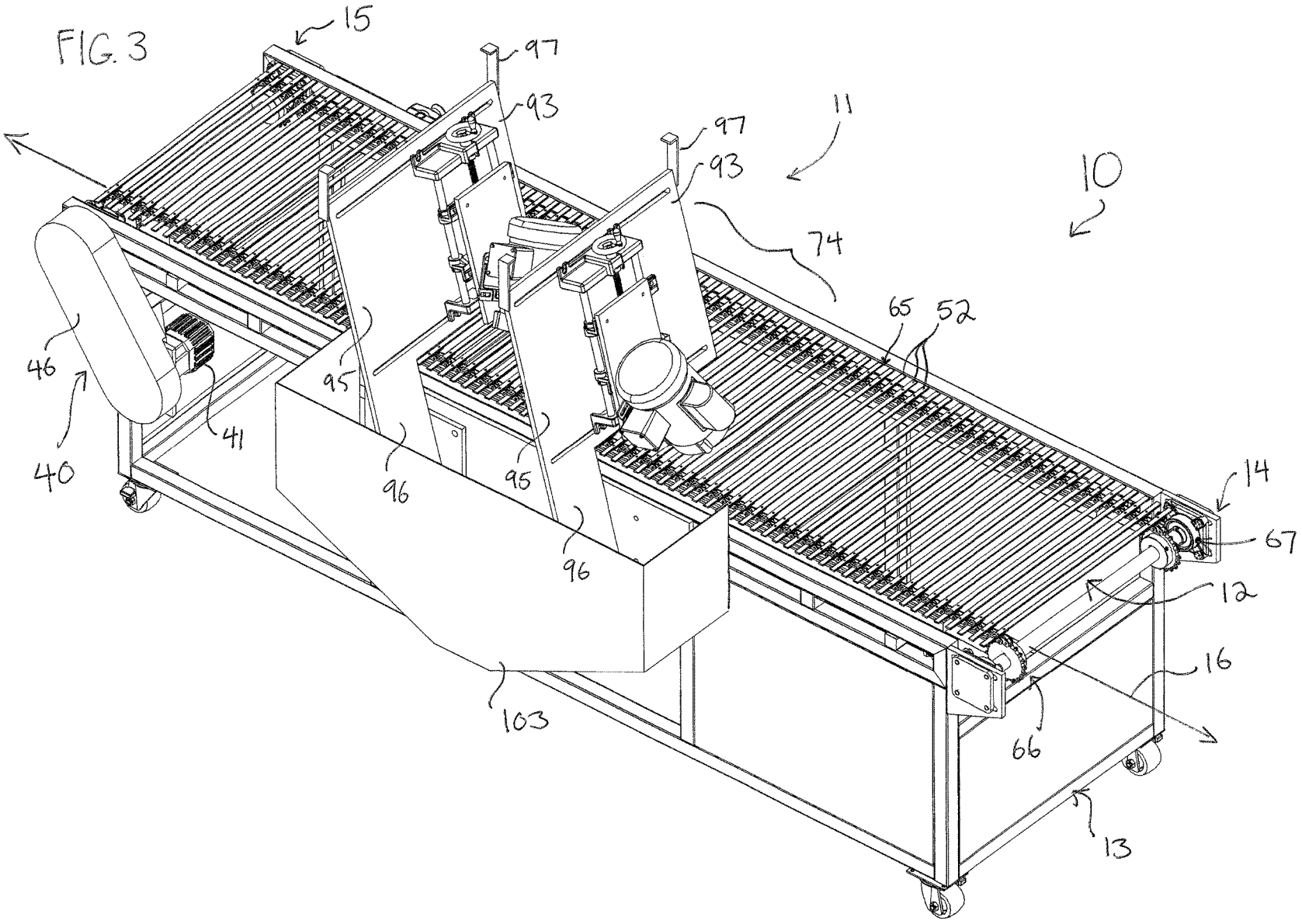
FIG. 3 is a rear, top perspective view of the machine of FIG. 1.
Figure 4:
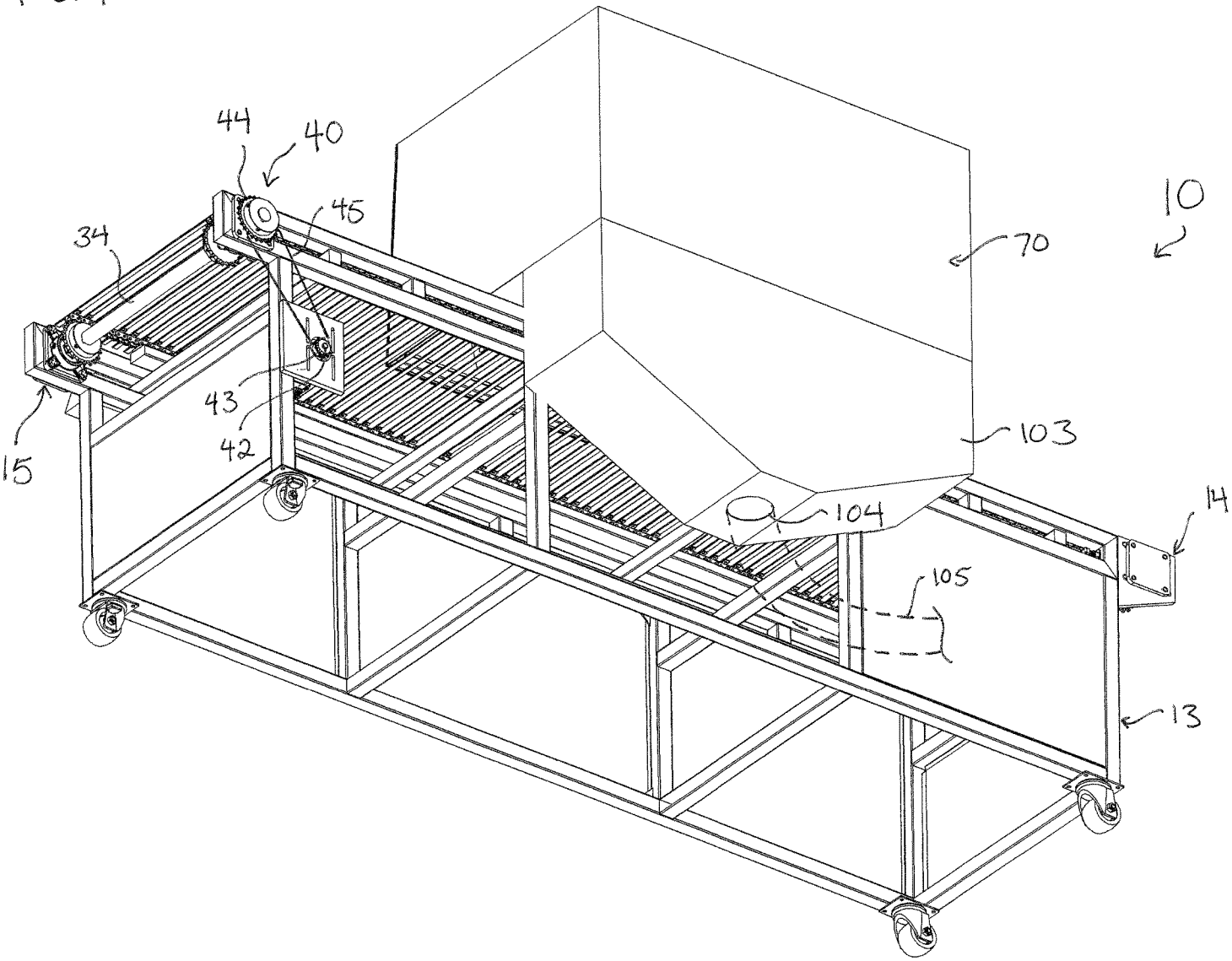
FIG. 4 is a front, bottom perspective view of the machine of FIG. 1.

Also mounted to the framework 13, on the backside thereof, is a drive assembly 40, as shown in FIGS. 3 and 4. The drive assembly 40 is preferably covered by a housing 46 (as shown in FIG. 3), but the housing 46 is removed in most of these drawings so that the drive assembly 40 under it can be seen. The drive assembly 40 includes a motor 41 that drives the track 12. The motor 41 is preferably mounted to the framework 13 below the track 12. The motor 41 has a drive shaft 42 extending laterally beyond a plate fixed to the framework 13, and a drive gear 43 is mounted on the drive shaft 42. The axle 34 at the downstream end 15 of the machine 10 projects through the framework 13, and a driven gear 44 is mounted on the end of the axle 34 projecting outward. A belt or drive chain 45 wraps around the drive gear 43 and driven gear 44 and couples the two in operation. When the motor 41 actuates, it rotates the drive gear 43. Rotational movement of the drive gear 43 imparts corresponding rotational movement to the driven gear 44 and to the axle 34 on which it is fixed. This, in turn, imparts movement to the track 12, causing the track 12 to preferably move from the upstream end 14 to the downstream end 15. In other embodiments, the motor 41 is differently mounted to the framework 13 or is even directly mounted to the driven gear 44.

Figure 5:
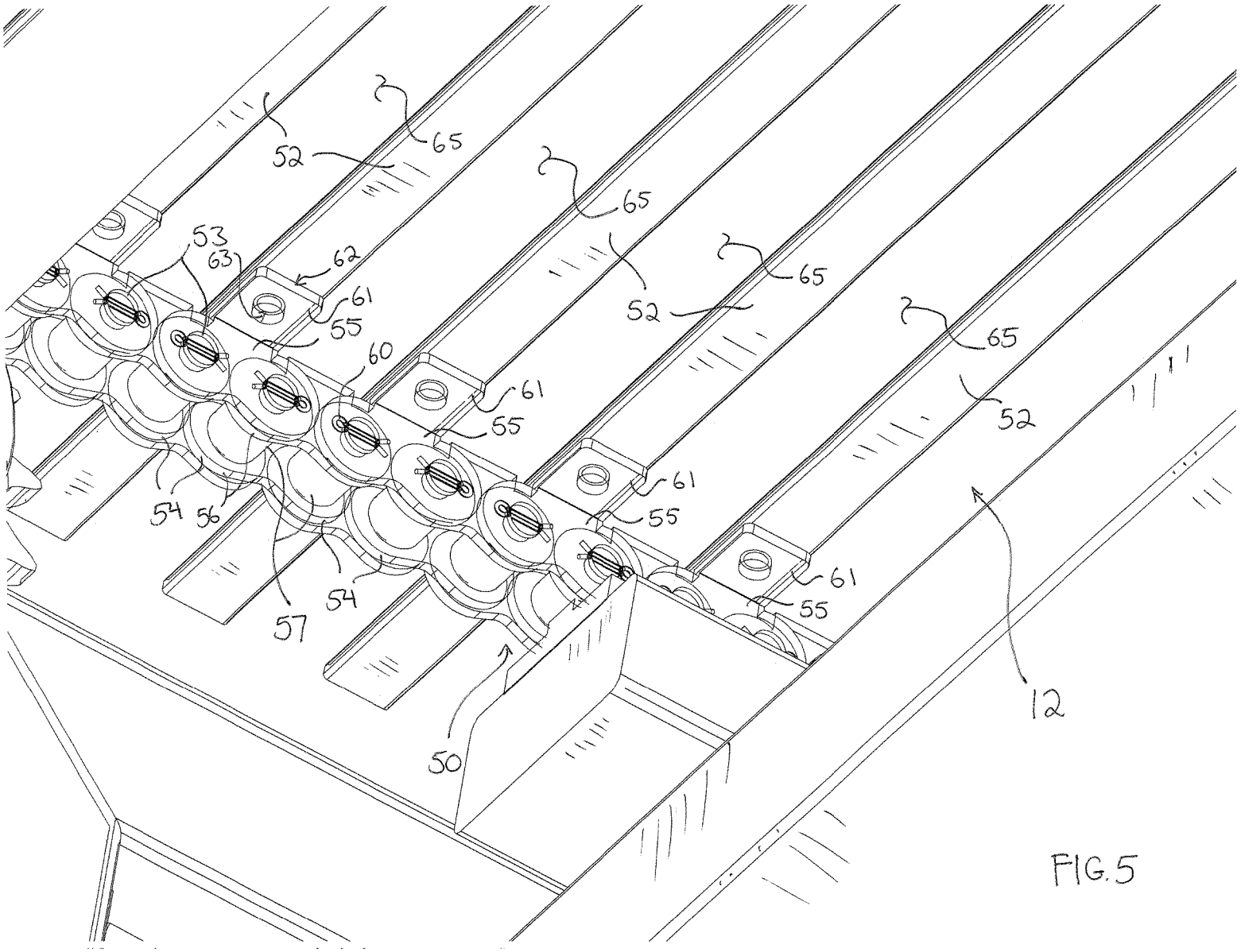
FIG. 5 is an enlarged view of the underside of the track of the machine of FIG. 1.

Turning back to FIG. 2, and also to FIG. 5, the track 12 includes two spaced-apart chains 50 and 51 and a large number of slats 52 fixed to the chains 50 and 51 and forming a movable support surface. The chains 50 and 51 are spaced apart from each other near the front and back of the machine 10. In FIG. 2, the chains 50 and 51 are broken at the gears 35. This is only so that the drawing can show the gears 35 clearly. In practice, of course, the chains 50 and 51 are unbroken and wrap around and under the gears 35 at the upstream end 14 and then down to the downstream end 15, where they wrap around and over the gears 35.

The chains 50 and 51 are identical; only one chain (chain 50) is described here with the understanding that the description applies equally to both. The chain 50 includes a large number of links connected to each other by pins 53. The links include both inner links 54 and outer links 55. Each inner link 54 is flanked by two outer links 55 in a staggered fashion. Each inner link 54 is connected to two upstream outer links 55 and two downstream outer links 55; each outer link 55 is connected to an upstream inner link 54 and a downstream inner link 54.

The inner link 54 has a double barrel construction. It includes two figure-eight shaped plates 56 with two axial holes formed therethrough. The plates 56 flank two short cylinders 57 which are arranged transversely with respect to the plates 56 and which are located concentrically with respect to the axial holes.

The outer link 55 is also a figure-eight shaped plate with two holes formed therethrough. One outer link 55 is adjacent one of the plates 56 of the inner link 54, and another outer link 55 is adjacent the opposite plate 56 of the inner link 54. A pin 60 connects the outer links 55 to the inner links 54, with the inner link 54 flanked by the outer links 55. In some embodiments, the pin 60 is press fit in the chain 50. In other embodiments, the pin 60 is secured with a cotter pin or the like, as shown in FIG. 5.

The outer link 54 has a support 61. The support 61 is an extension projecting outwardly from the middle of the outer link 55. The support 61 includes an upper face 62 and has a hole 63 formed vertically entirely through the support 61. A bolt or screw may be passed through the hole 63 to secure the slat 52 above to the support 61, thereby securing the slat 52 to the chain 50. No such bolt or screw is shown here for clarity of the illustration. Another fastener or fastening method is also suitable, such as a weld. The slats 52 are spaced apart along the length of the chain 50 and thus along the length of the track 12. The slats 52 are thin, rigid, strong elements. They are just longer than the distance spacing the chains 50 and 51 apart from each other. The slats 52 are spaced apart from each other, thereby defining a plurality of longitudinal openings 65 entirely through the track 12 between adjacent slats 52.

Referring back to FIG. 2, along the back of the machine 10, some of the slats 52 carry stops 64. The track 12 has two sides: a far or first side 66 which is along the back of the machine 10 and is away from the operator when operating the machine 10, and a near or second side 67 which is along the front of the machine 10 and is close to the operator when operating the machine 10. The stops 64 are spaced just inboard of the first side 66. Preferably, the stops 64 are carried by every other slat 52, though in some embodiments, the stops 64 are on every slat 52 or spaced further apart on the slats 52.

The stops 64 are small square-shaped studs projecting slightly upward from upper faces 68 of the slats 52. The stops 64 are spaced apart from the ends of the slats 52 by an equal distance, such that the stops 64 are registered with each other along a longitudinal axis, indicated with a double-arrowed line 16 in FIG. 3, extending between the upstream and downstream ends 14 and 15. When a screen printing frame 19 is placed atop the track 12, the operator pushes the frame 19 toward the first side 66 of the track 12 and against the stops 64. The operator thus uses the stops 64 to properly register and align the frame 19 with the grinding assembly 11.

The grinding assembly 11 is disposed over part of the track 12; it is above the first side 66 of the track 12 but preferably not over the second side 67. The second side 67 is uncovered so that the operator can handle and manipulate the frame 19 from the second side 67 without interference or danger from interaction with the grinding assembly 11. The operator pushes each frame 19 against the stops 64, which hold the frames 19 consistently in the same position laterally on the track 12, thereby ensuring that each frame 19 is consistently located under the grinding assembly 11.

Figure 8:
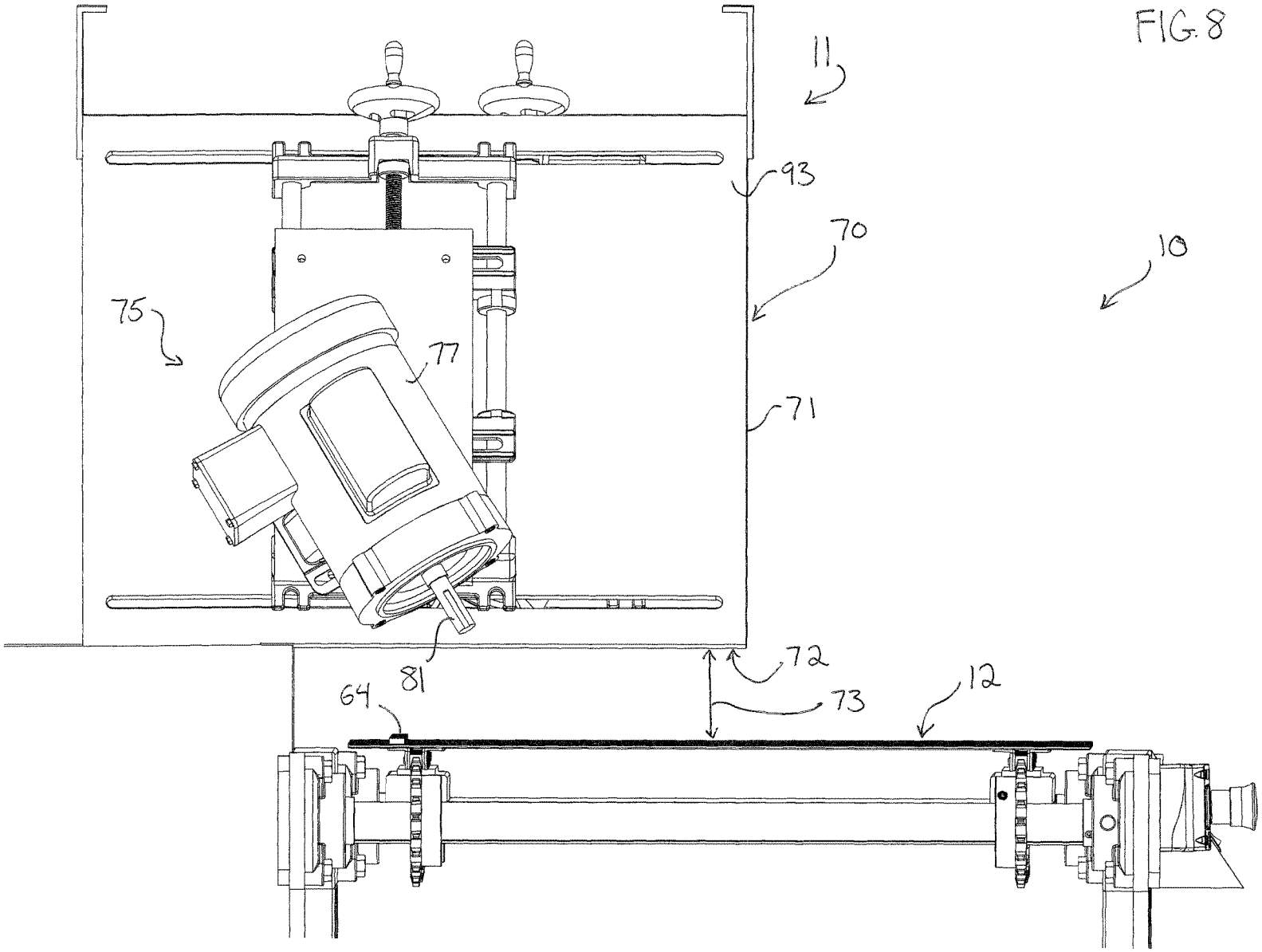
FIG. 8 is an enlarged elevation view of the grinding assembly of the machine from the upstream end thereof.
Figure 9:
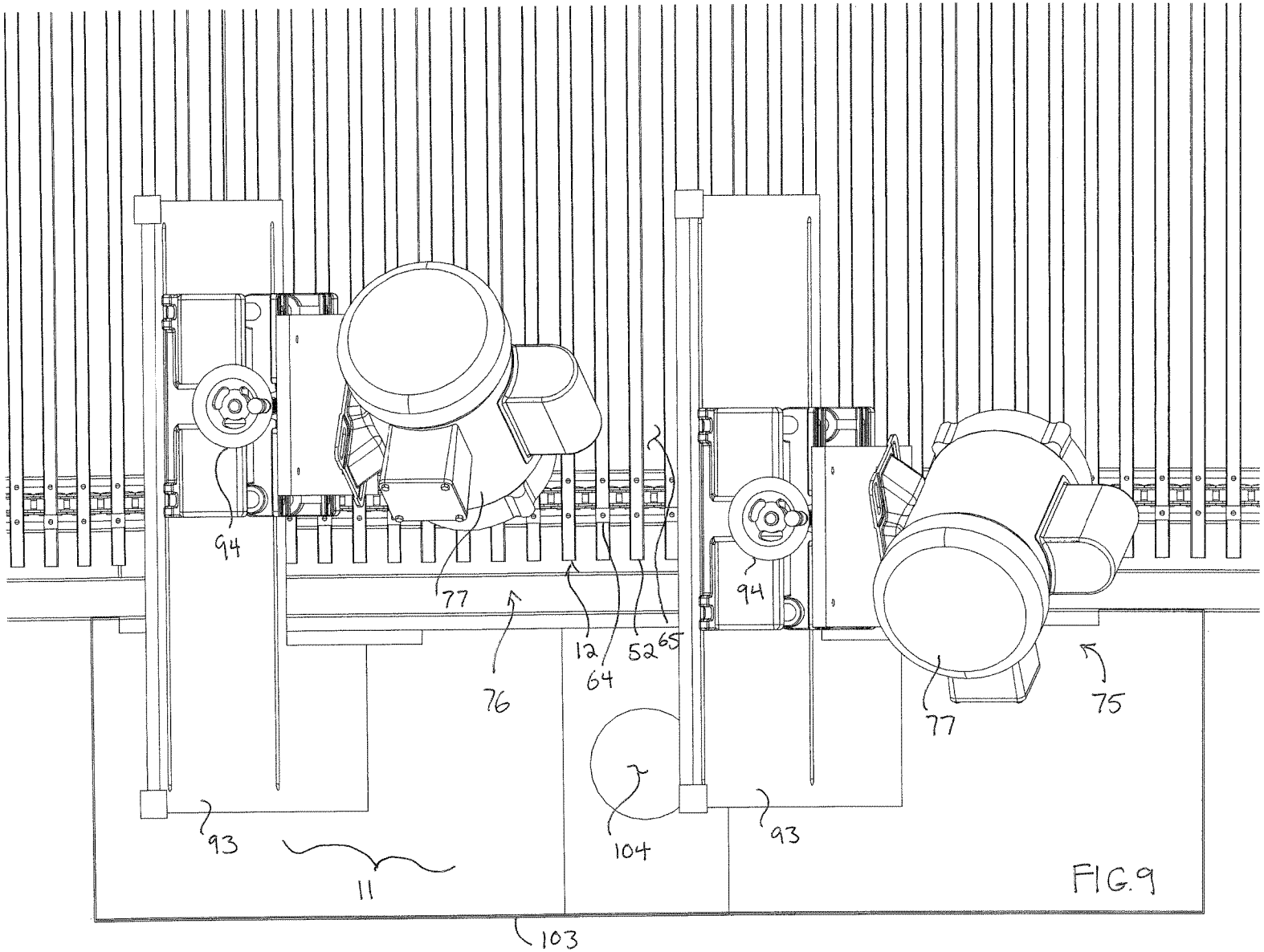
FIG. 9 is an enlarged top plan view of the grinding assembly of FIG. 6.

FIG. 1 shows the grinding assembly 11 inside a housing or enclosure or hood 70. The hood 70 is shown in transparency in FIG. 1 so that the grinding assembly 11 is visible. In other drawings, the hood 70 is removed completely for clarity of the illustration. The hood 70 is a large box fitting over the grinding assembly 11 and partially overlying the track 12. The hood 70 has a hinged door 71 on the front thereof and an open bottom 72. The bottom 72 of the hood 71 is spaced above the upper faces 68 of the slats of the track 12 to define a gap 73 between the hood 70 and the track 12, as shown in FIG. 8. The gap 73 has a height between the bottom 72 of the hood 71 and track 12 which corresponds to a thickness 78 of the screen printing frame 19; the gap 73 is just larger than the frame 19 so that the frame 19 can slide under the hood 71 with a small clearance.

When the machine 10 is operating, the door 71 is preferably down in a closed position for safety. In some embodiments, the hood 70 includes a safety switch that requires the door 71 to be closed before the machine 10 will energize and operate. The door 71 has a transparent window so that the operator can observe the machine 10 while it is operating. The operator can open the door 71 when the machine 10 is not in operation to adjust or maintain the grinding assembly 11.

The grinding assembly 11 is in a grinding location 74 between the upstream and downstream ends 14 and 15. The grinding assembly 11 includes two grinders 75 and 76, both of which are mounted within the grinding location 74. The first grinder 75 is upstream of the second grinder 76, and the second grinder 76 is registered downstream of the first grinder 75 parallel to the longitudinal axis 16.

The grinders 75 and 76 are structurally identical but are mounted differently. This specification refers primarily to the grinder 75 in discussing structure and function with the understanding that the description applies equally to the other grinder 76. Most of the discussion is with respect to FIG. 6.

The grinder 75 includes a motor 77 mounted above and directed downward toward the track 12. The motor 77 includes a housing 80 containing an electric motor. A shaft 81 extends out of the housing 80 and is carried by the electric motor for rapid rotation. Grinding media, such as a grinding disc 82, is fixed to the shaft 81. The grinding disc 82 has an abrasive lower face directed downward toward the track 12. The grinding disc 82 is preferably flexible. The grinding disc 82 is not shown in several of the drawings for clarity of the illustrations. In other embodiments, the grinding media may be of a different type, such as a rigid grinding wheel, stiff brush, burr, file, or the like.

The grinder 75 is mounted on an adjustable armature 83 above the track 12. The armature 83 includes a plate 84 to which the motor 77 is secured. The plate 84 is mounted on two rails 85 and 86, which are mounted to two transverse bars 87. The plate 84 is laterally adjustable on the rails 85 and 86. The operator can slide and secure the plate 84 left and right along the rails 85 and 86 to adjust the plate (and thus the motor 77) laterally above the track 12.

A long threaded bolt 90 extends through threaded holes in both rails 85 and 86. The bolt 90 is carried for rotation in two end brackets 91 and 92 that project above a board 93. A knob or wheel 94 fixed to one end of the bolt 90 allows the operator to rotate the bolt 90 which causes the rails 85 and 86 to move toward or apart from each other on the bars 87, which causes the plate 84 to move up and down, away from and toward the track 12. The end brackets 91 and 92 can also be adjustably mounted on the board 93 for gross lateral adjustment. In other embodiments, the board 93 is substantially smaller and the adjustments are implemented by precision knobs mounted on the ends of threaded bolts. In other embodiments, electromechanical adjustment mechanisms control the orientation of the grinder 75.

Figure 6:
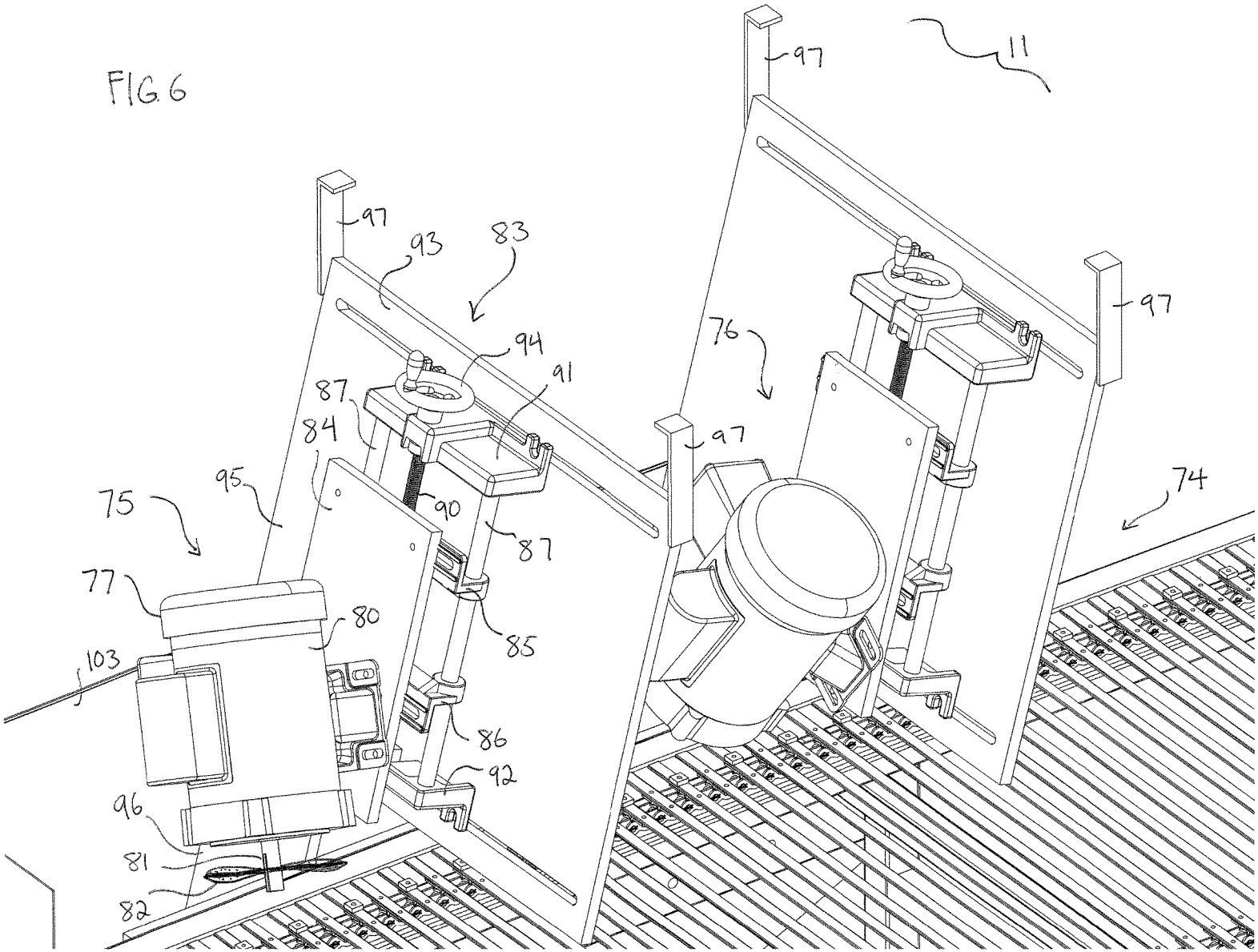
FIG. 6 is an enlarged view of a grinding assembly of the machine of FIG. 1.
Figure 7:
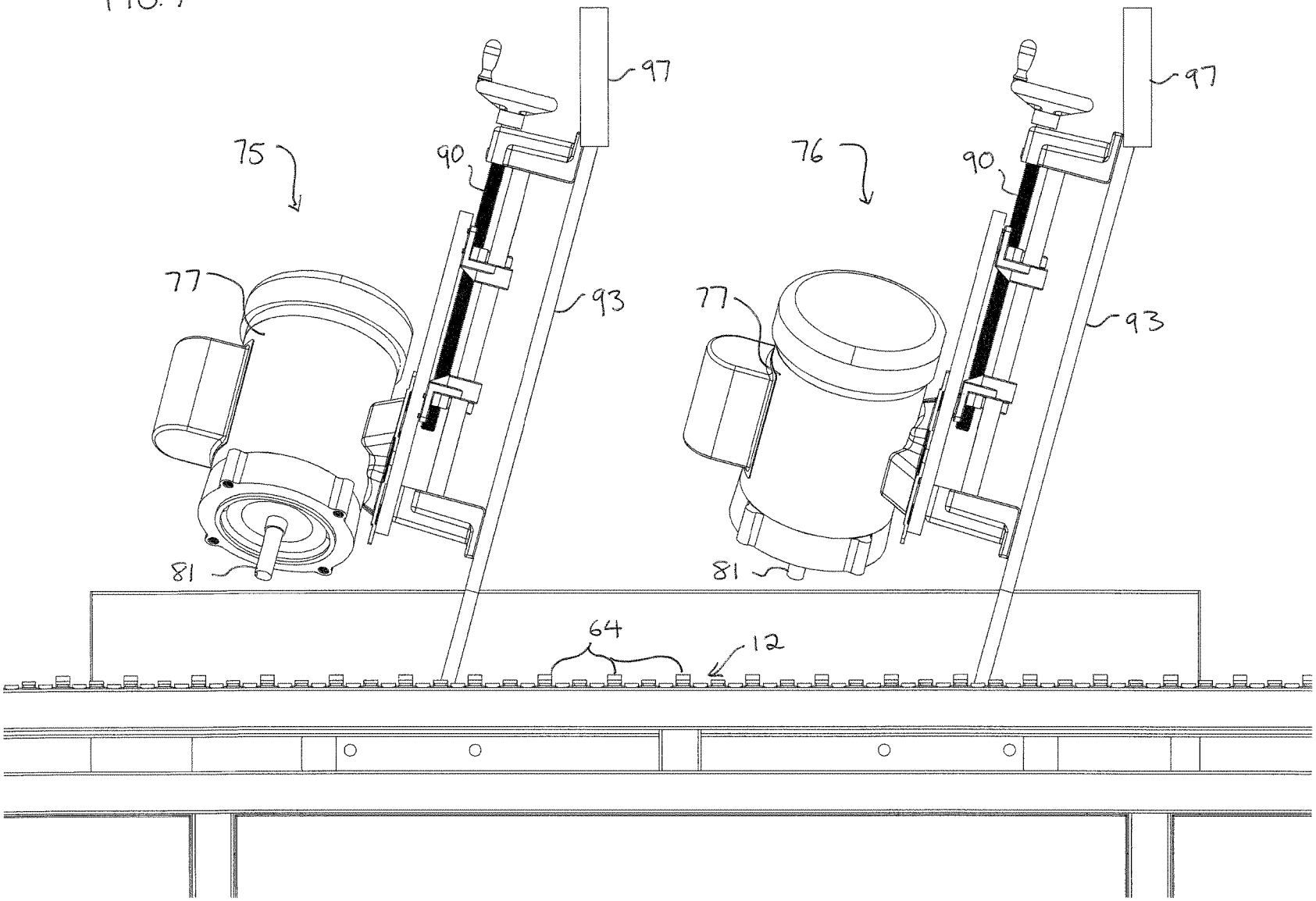
FIG. 7 is an enlarged side elevation view of the grinding assembly of FIG. 6.

The board 93 is fixed at an angle. As shown in FIGS. 3 and 6, the board 93 includes a large rectangular mounting portion 95 as well as a depending leg 96. The leg 96 extends downward, behind the track 12, where it is fixed to the framework 13. The top corners of the board 93 are fixed to the inside of the hood 70 with brackets 97. These three attachment points hold the board 93 at an angle. In other embodiments, the board 93 is smaller and is supported solely at the framework 13.

As seen in FIGS. 6-9, the grinders 75 and 76 are mounted at an angle with respect to the track 12. When viewed from the front of the machine 10 (as in FIG. 7), both grinders 75 and 76 lean back toward the downstream end 15. The shafts 81 of the motors 77 of the two grinders 75 and 76 are directed downward and slightly forward, extending out of the motors 77 slightly from the downstream end 15 toward the upstream end 14.

When viewed from the upstream end 14 of the machine 10 (as in FIG. 8), the grinder 75 is angled from the back of the machine 10 toward the front of the machine 10. The grinder 76 behind it is opposite, angled from the front of the machine 10 toward the back of the machine 10. The grinders 75 and 76 thus have first and second orientations which are different with respect to each other. Because longithe grinders 75 and 76 have different orientations, at least, the grinders grind different grinding patterns into the frame 19 as it moves underneath.

When viewed from above the machine 10 (as in FIG. 9), the grinder 75 is offset on its board 93 toward the back of the machine 10, and the grinder 76 is offset on its board 93 toward the front the machine 10. The shafts 81 of both motors 77, however, are positioned above the same lateral location along the track 12. In other words, the ends of the shafts 81 are roughly disposed the same distance away from the back of the machine 10 or the back of the track 12, such that a frame 19 moving with the track 12 will sequentially move under both grinding discs 82 on both shafts 81. The shafts 81 both terminate just inboard of the stops 64.

The grinders 75 and 76 and the drive motor 41 are all coupled to electrical power. In operation, the operator closes the door 71 of the hood 70 and turns the machine 10 on at a control panel 100, which preferably has a touchscreen 101 and an emergency shut-off 102. The motor 41 operates and spins the drive gear 43, in turn rotating the driven gear 44 and causing the track 12 to move from the upstream end 14 to the downstream end 15. The motors 77 of the grinders 75 and 76 also begin operating, turning the shafts 81 quickly and rotating the grinding discs 82 mounted thereon.

The operator then places a used frame 19 atop the track 12 and against the stops 64, proximate the upstream end 14. The operator allows the frame 19 to be moved by the track 12 downstream. The grinding disc 82 of the upstream grinder 75 grinds a face on one side of the frame 19 with one grinding pattern, and the grinding disc 82 of the downstream grinder 76 grinds that same face with a second, different grinding pattern. Because the two grinding discs 82 are mounted on shafts 81 which are oriented differently, the machine grinds a cross pattern onto the face.

The machine 10 collects fine debris removed from the frame 19. A basin 103 is mounted below the grinding assembly 11. The basin 103 is a large collection reservoir having an open top, closed sidewalls, and a substantially closed bottom. In some embodiments, the basin 103 is directly below the grinding assembly under the track 12, so that shavings, dust, and other debris created during operation of the machine 10 can fall through the openings 65 between the slats 52 and into the basin 103. In other embodiments, the basin 103 is offboard of the first side 66 of the track 12, at the back of the machine 10. In either embodiment, the basin 103 is preferably in open communication with the open bottom 72 of the hood 70, and basin 103 pulls shavings, dust, and other debris in by force of vacuum. The basin 103 has a port 104 at its bottom to which a vacuum can be coupled. The vacuum is shown in FIG. 4 in truncated phantom line marked with the reference character 105. When the machine 10 is operating, the vacuum 105 draws air through the port 104 and through the basin 103. Debris coming off the frame 19 is drawn into the basin 103 and then into the vacuum 105.

The frame 19 emerges out from under the hood 70. The operator picks the frame 19 up, re-orients it so that another side can be prepared by the machine 10, and then places the frame 19 back onto the track 12 proximate the upstream end 14. The grinding discs 82 then grind another side of the frame 19. The operator repeats this process for each part of the frame 19 that needs to be cleaned. This process takes approximately one to two minutes to fully prepare a frame 19 for re-use in screen printing.

A preferred embodiment is fully and clearly described above so as to enable one having skill in the art to understand, make, and use the same. Those skilled in the art will recognize that modifications may be made to the description above without departing from the spirit of the specification, and that some embodiments include only those elements and features described, or a subset thereof. To the extent that modifications do not depart from the spirit of the specification, they are intended to be included within the scope thereof.

What is claimed is:

1. A machine for processing a screen printing frame, the machine comprising:

an upstream end and an opposed downstream end of a track;

a grinding assembly located between the upstream and downstream locations; and the grinding assembly includes a first grinder configured to grind a first grinding pattern into the screen printing frame and a second grinder configured to grind a second grinding pattern into the screen printing frame different from the first grinding pattern;

the first grinder is mounted on a first plate for lateral adjustment on a first rail, which first rail is mounted for vertical adjustment on a first bar, which first bar is mounted in first end brackets fixed to a first board set at a first angle;

the second grinder is mounted on a second plate for lateral adjustment on a second rail, which second rail is mounted for vertical adjustment on a second bar, which second bar is mounted in second end brackets fixed to a second board set at the first angle;

the first and second boards each are L-shaped, having a mounting portion and a leg depending downward from the mounting portion behind a far side of the track;

the legs of the first and second boards depend downward into a basin behind the track, wherein the basin includes a vacuum port configured to connect to a vacuum for removing debris falling into the basin;

a hood over the grinding assembly, wherein the hood does not cover a near side of the track opposite the far side so that the screen printing frame may be held and guided through the grinding assembly and under the first and second grinders, but the hood does cover the grinding assembly, the far side of the track, and the basin behind the track;

the first and second grinders are both set at a second angle leaning back toward the downstream end of the track, the first and second grinders have first and second orientations, respectively, which are opposite to each other; and the first and second grinders have shafts which terminate in a common lateral location above the track, such that the first and second grinders are configured to grind a same part of the screen printing frame when the screen printing frame moves under the grinding assembly, first forming the first grinding pattern from the first grinder and then the second grinding pattern from the second grinder, the first and second grinding patterns cooperating to form a cross grinding pattern in the screen printing frame.

2. The machine of claim 1, wherein the track is mounted to move the screen printing frame from the upstream end to the downstream end.

3. The machine of claim 2, wherein the grinding assembly is disposed over the far side of the track, and the opposed far side of the track is uncovered.

4. The machine of claim 2, wherein the track includes opposed chains, spaced-apart slats extending between the chains, and stops projecting upwards from each slat, wherein the stops are registered with each other along a line proximate and parallel to the far side of the track.

5. The machine of claim 1 wherein the hood is spaced above the track to define a gap configured to receive a thickness of the screen printing frame.

6. The machine of claim 1, wherein the basin is below the grinding assembly.

7. A machine for processing a screen printing frame, the machine comprising:

a track for downstream movement of the screen printing frame along a longitudinal axis from an upstream end of the track to an opposed downstream end of the track, the track having a far side and an opposed near side;

a grinding location between the upstream and downstream ends;

a first grinder mounted in the grinding location and configured to grind a first grinding pattern, wherein the first grinder is mounted on a first plate for lateral adjustment on a first rail, which first rail is mounted for vertical adjustment on a first bar, which first bar is mounted in first end brackets fixed to a first board set at a first angle; and a second grinder mounted in the grinding location downstream from the first grinder and configured to grind a second grinding pattern, wherein the second grinder is mounted on a second plate for lateral adjustment on a second rail, which second rail is mounted for vertical adjustment on a second bar, which second bar is mounted in second end brackets fixed to a second board set at the first angle;

the first and second boards are spaced apart, each being L-shaped and having a mounting portion and a leg depending downward from the mounting portion behind the far side of the track;

the legs of the first and second boards depend downward into a basin behind the track, wherein the basin includes a vacuum port coupled to a vacuum for removing debris falling into the basin;

a hood disposed in the grinding location above the first and second grinders, wherein the hood does not cover the near side of the track so that the screen printing frame may be held and guided through the grinding location under the first and second grinders;

the first and second grinders are both et at a second angle leaning back toward the downstream end of the track; and the first and second grinders have first and second orientations, respectively, which are opposite to each other, such that the first grinding pattern is opposite the second grinding pattern and the first and second grinding patterns cooperate to form a cross grinding pattern in the screen printing frame.

8. The machine of claim 7, wherein the first and second grinders are registered with each other along a line parallel to the longitudinal axis.

9. The machine of claim 7, wherein the hood has an open bottom.

10. The machine of claim 7, wherein the track is formed with a plurality of openings through the track.

11. The machine of claim 7, wherein the first and second grinders are disposed over the far side of the track, and the near side of the track is uncovered.

12. A machine for processing a screen printing frame, the machine comprising:

a track for downstream movement of the screen printing frame along a longitudinal axis from an upstream end of the track to an opposed downstream end of the track;

a grinding location between the upstream and downstream ends, the grinding location covered by a hood which extends over a far side of the track but not a near side of the track, so that the screen printing frame may be held and guided through the grinding location under the hood;

a first grinder mounted in the grinding location, the first grinder comprising a first motor, a first shaft coupled to the first motor for driven rotation, and a first grinding media on the first shaft, wherein the first grinder is mounted on a first plate for lateral adjustment on a first rail, which first rail is mounted for vertical adjustment on a first bar, which first bar is mounted in first end brackets fixed to a first board set at a first angle; and a second grinder mounted in the grinding location, the second grinder comprising a second motor, a second shaft coupled to the second motor for driven rotation, and a second grinding media on the second shaft, wherein the second grinder is mounted on a second lateral adjustment on a second rail, which second rail is mounted for vertical adjustment on a second bar, which second bar is mounted in second end brackets fixed to a second board set at the first angle;

the first and second boards are each L-shaped and have a mounting portion and a leg depending downward from the mounting portion behind the far side of the track;

the legs of the first and second boards depend downward into a basin behind the far side of the track, wherein the basin includes a vacuum port coupled to a vacuum for removing debris falling into the basin;

the first and second grinders are both set at a second angle leaning back toward the downstream end of the track; and the first and second grinders have first and second orientations, respectively, which are opposite to each other, such that the first grinding pattern is opposite the second grinding pattern and the first and second grinding patterns cooperate to form a cross grinding pattern in the screen printing frame.

13. The machine of claim 12, wherein the first and second grinders are registered with each other along a line parallel to the longitudinal axis.

14. The machine of claim 12, wherein the hood has an open bottom.

15. The machine of claim 12, wherein the track is formed with a plurality of openings through the track.

16. The machine of claim 12, wherein the first and second grinders are disposed over the far side of the track, and the near track is uncovered.

* * * * *